US011203471B2

(12) United States Patent
Pham et al.

(10) Patent No.: US 11,203,471 B2
(45) Date of Patent: Dec. 21, 2021

(54) PILL BOTTLE WITH REMOVABLE PILL CONTAINER CAP

(71) Applicant: Esprit Innovations, LLC, Woodland Hills, CA (US)

(72) Inventors: Christopher Pham, Calabasa, CA (US); Robert Shiepe, Playa Del Rey, CA (US)

(73) Assignee: Esprit Innovations, LLC, Woodland Hills, CA (US)

( * ) Notice: Subject to any disclaimer, the term of this patent is extended or adjusted under 35 U.S.C. 154(b) by 0 days.

(21) Appl. No.: 15/985,673

(22) Filed: May 21, 2018

(65) Prior Publication Data

US 2019/0352065 A1 Nov. 21, 2019

(51) Int. Cl.

| | |
|---|---|
| ***B65D 51/28*** | (2006.01) |
| ***B65D 83/04*** | (2006.01) |
| ***A61J 1/03*** | (2006.01) |
| ***B65D 41/04*** | (2006.01) |
| ***B65D 41/16*** | (2006.01) |

(52) U.S. Cl.

CPC ..... *B65D 51/28* (2013.01); *A61J 1/03* (2013.01); *B65D 41/04* (2013.01); *B65D 41/16* (2013.01); *B65D 83/04* (2013.01)

(58) Field of Classification Search

CPC ..... B65D 25/04; B65D 51/28; B65D 83/04; B65D 83/0409; B65D 83/049; B65D 81/3216; B65D 41/04; B65D 41/16; A61J 1/03; A61J 7/04

USPC ..... 215/227; 220/521, 523

See application file for complete search history.

(56) References Cited

U.S. PATENT DOCUMENTS

| | | | | |
|---|---|---|---|---|
| 2,317,882 | A | 4/1943 | Boesel | |
| 3,433,378 | A * | 3/1969 | Ross | B65D 51/28 215/6 |
| 6,243,936 | B1 | 6/2001 | Biesecker | |
| 6,545,592 | B2 | 4/2003 | Weiner | |
| 7,055,709 | B1 | 6/2006 | Esau | |
| 9,078,535 | B1 * | 7/2015 | Buck | A47G 19/2205 |
| 9,617,050 | B2 | 4/2017 | Dreyer | |
| 2005/0150805 | A1 | 7/2005 | Burchell | |

(Continued)

FOREIGN PATENT DOCUMENTS

| | | |
|---|---|---|
| WO | 2013/036692 A2 | 3/2013 |
| WO | WO2017/013007 | 1/2017 |

OTHER PUBLICATIONS

International Preliminary Report on Patentability, Written Opinion of the International Searching Authority, and International Search Report for PCT/US2019/033195, Nov. 24, 2020.

*Primary Examiner* — Anthony D Stashick
*Assistant Examiner* — Lauren Kmet
(74) *Attorney, Agent, or Firm* — Muskin and Farmer LLC

(57) ABSTRACT

A method and system to provide a pill bottle with a removable pill cap case. A bottle cap has a hollow area which receives the removable pill cap case which fits (snaps) into the bottle cap. The removable pill cap case has a flip-top lid which can open and close and enable pills to be placed therein. As such, a user can open the pill bottle, place one or more of the pills inside the removable pill cap case, close the removable pill cap case, and then carry the removable pill cap case around with him/her without having the carry the entire pill bottle.

13 Claims, 7 Drawing Sheets

(56) References Cited

U.S. PATENT DOCUMENTS

| | | | | |
|---|---|---|---|---|
| 2007/0264075 | A1* | 11/2007 | Panasci | A46B 5/002 401/289 |
| 2009/0050514 | A1* | 2/2009 | Devaux-Day | A61J 1/03 206/538 |
| 2010/0025356 | A1* | 2/2010 | Lee | B65D 47/243 215/227 |
| 2011/0036803 | A1* | 2/2011 | Mejia | B65D 51/28 215/228 |
| 2011/0278195 | A1 | 11/2011 | Giocastro | |
| 2012/0248004 | A1 | 10/2012 | Naghavi | |
| 2013/0152515 | A1 | 6/2013 | Valdez | |
| 2016/0159555 | A1* | 6/2016 | Park | B65D 83/049 221/175 |

* cited by examiner

PILL BOTTLE WITH REMOVABLE PILL CONTAINER CAP

BACKGROUND OF THE INVENTION

Field of the Invention

The present general inventive concept is directed to a method, apparatus, and computer readable storage medium directed to a pill bottle with a removable cap which is itself a pill cap case.

Description of the Related Art

When a person has a pill bottle full of prescription pills, compliance with the directions can sometimes be a challenge. Carrying around an entire bottle (or bottles) of pills can be inconvenient, and counting up ones daily prescribed pills can be cumbersome.

What is needed is an improved pill bottle which can improve a patient's compliance and also make it easier for the patient to comply.

SUMMARY OF THE INVENTION

It is an aspect of the present invention to provide an improved pill bottle.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
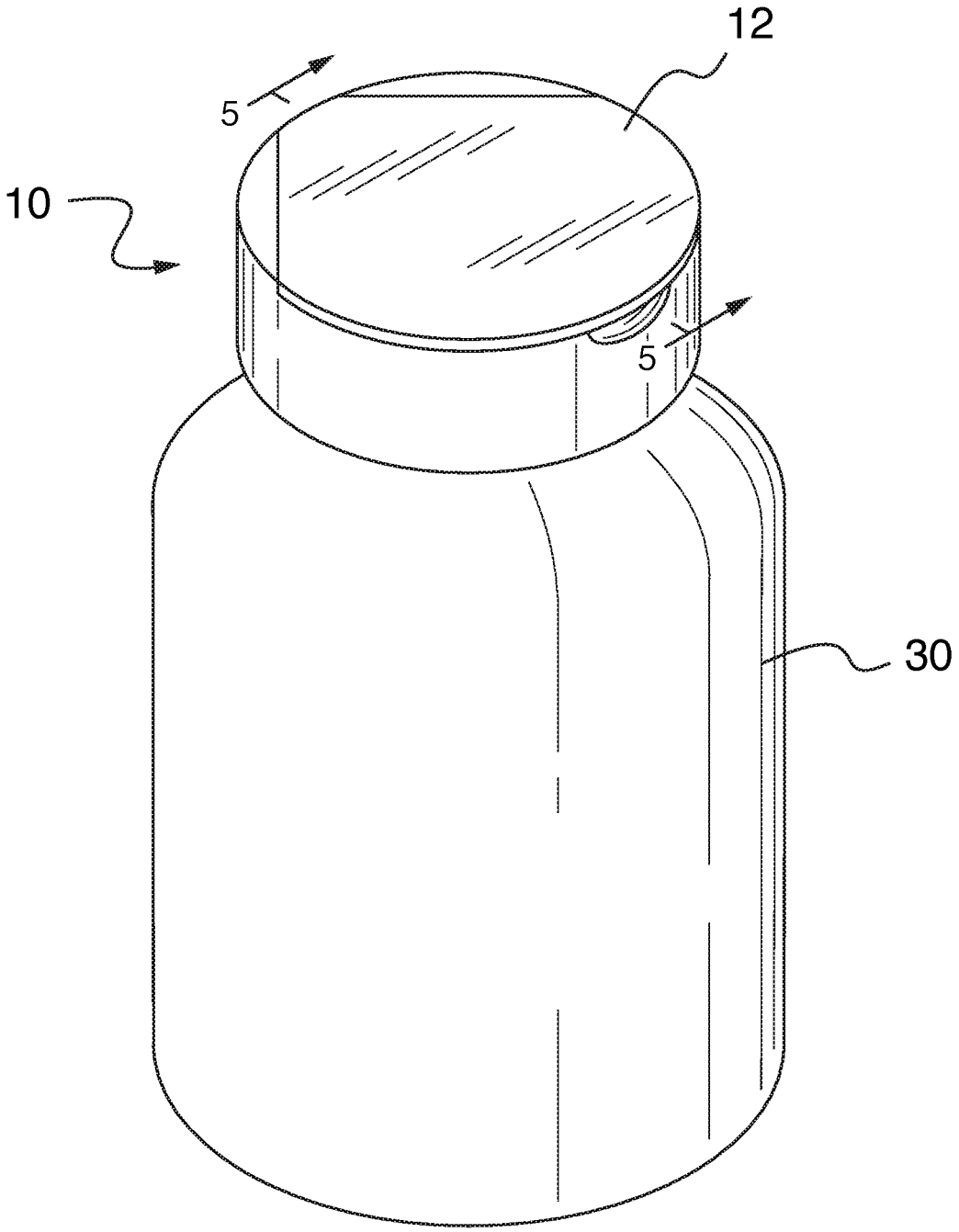
FIG. 1 is perspective drawing of a pill bottle, according to an embodiment.

Reference will now be made in detail to the presently preferred embodiments of the invention, examples of which are illustrated in the accompanying drawings, wherein like reference numerals refer to like elements throughout.

The general inventive concept relates to a pill bottle with a removable pill cap case which fits on top of a bottle cap. The bottle cap is threaded and screws onto threads located on a neck of the bottle. The bottle cap has a circular opening which receives the removable pill cap case which fits inside the opening via a friction fit (also known as interference fit). The removable pill cap case can easily be removed from the bottle cap (while the bottle cap is attached to the bottle or when the bottle cap is removed from the bottle) and easily inserted into the bottle cap (while the bottle cap is attached to the bottle or when the bottle cap is removed from the bottle). The removable pill cap case has a flip-top lid which can easily open and close. When the flip-top lid is opened, it allows access to a reservoir which can store pills.

This structure can encourage compliance to a prescription medicine regimen. The bottle itself can store a large quantity (or any quantity) of pills, while the user can also store a selected number of pills inside the reservoir. The user can then remove the removable pill cap case from the bottle and thus have a small form factor to carry around instead of the larger pill bottle. This user can keep the removable pill cap case in his/her pocket and thus can access the pill(s) stored therein as needed.

As one example of how the system and methods described herein can be applied, assume a user is required to take a particular prescription pill three times a day (one pill per meal). The "old" method would be to take a pill from the bottle with breakfast at home, and then take the bottle to work and take a pill from the bottle during lunch, and assuming the user also has dinner before returning home from work, takes another pill from the bottle at dinner before returning home. It can be inconvenient to carry the entire bottle around to one's employment. In addition, the pill bottle could be lost, and the user may have privacy concerns about carrying his medication bottle around with him.

The improved method utilizing the methods and apparatuses described herein would have the user take his morning pill at breakfast from the pill bottle. The user would then put two pills inside the reservoir in the removable pill case (also referred to as pill cap case), remove the pill cap case and put it in his pocket. Now, the user can conveniently take a pill out of the reservoir to take during lunch and another during dinner. When the user returns home, he can snap the removable pill cap case back onto the pill cap, and repeat this process daily. As such, the user does not have to carry his entire pill bottle around with during his daily routine. In addition, the user also does not have to utilize a separate pill cap case that can easily get lost. Because the removable pill cap case fits and secures right back onto the pill bottle (technically onto the pill cap which can be attached to the pill bottle), the potential for losing the removable pill cap case is reduced. There are many other use cases for this apparatus described herein, and this is merely one example.

The pill bottle can be sold with the pills inside and the removable pill cap case already attached, thereby obviating the need for the user to purchase a separate pill cap case which can easily get lost.

FIG. 1 is perspective drawing of a pill bottle, according to an embodiment.

A pill dispensing system 10 contains a removable pill cap case 12 attached to a pill bottle 30. The pill dispensing system comprises the removable pill cap case 12, the pill bottle 30, and a bottle cap (not shown in FIG. 1).

Figure 2:
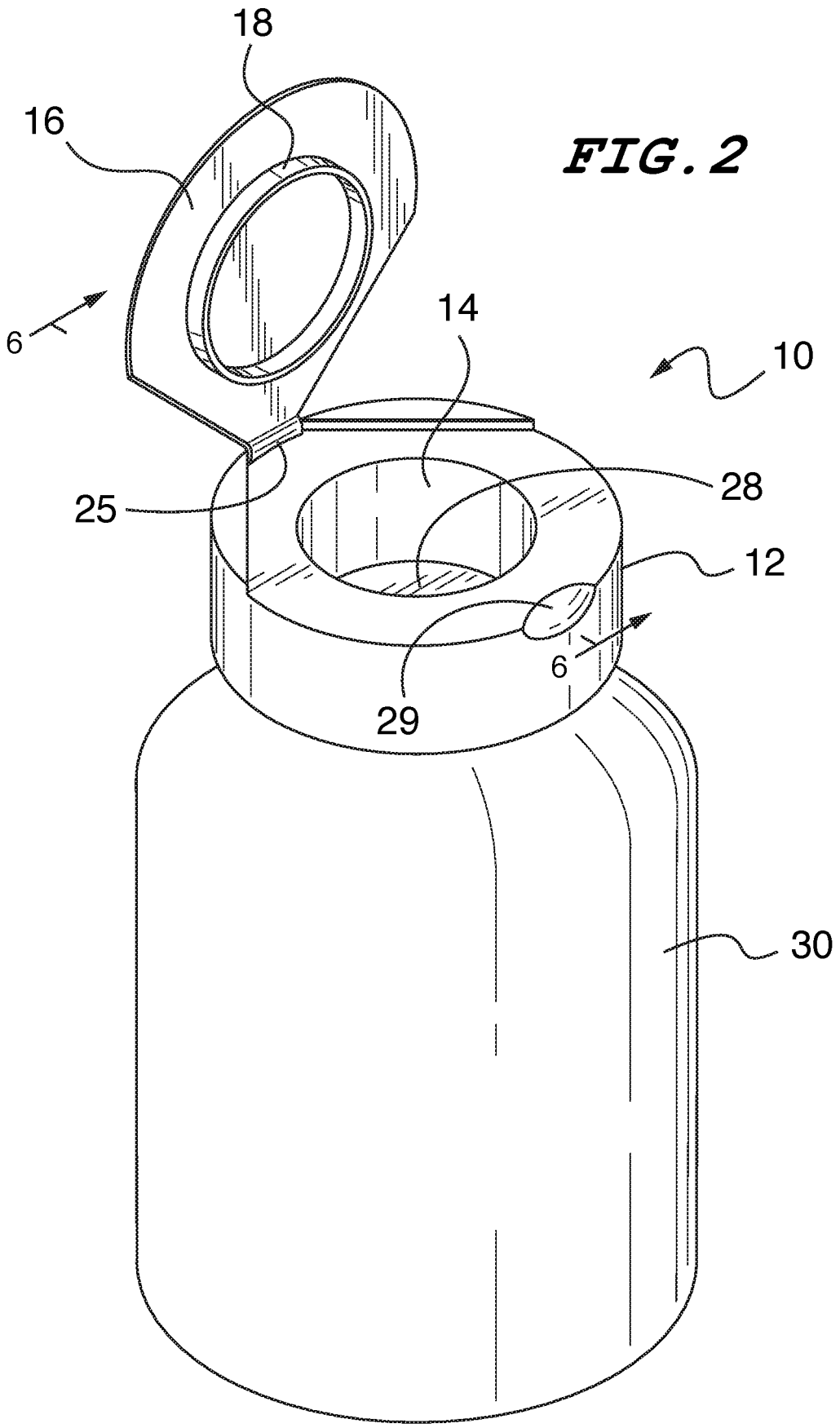
FIG. 2 is a perspective drawing of the pill bottle with the flip-top lid open, according to an embodiment.

FIG. 2 is a perspective drawing of the pill bottle with the flip-top lid open, according to an embodiment.

A flip-top lid 16 is connected to the removable pill cap case and can flip open and closed. A ring 18 on the flip-top lid 16 would friction fit securely inside a round perimeter 14 inside the flip top lid thereby causing the flip-top lid 16 to be securely closed (and typically would not open unless manually opened by the user). The flip-top lid 16 would be opened by the user by the user pressing his/her nail into a recess 29 on the removable pill cap case 12 and pulling (or pressing) the flip-top lid 16 open. The removable pill cap case 12 has a floor 28. The empty inside of the removable pill cap case 12 inside the round perimeter 14 is called a reservoir (which is where the pill(s) are stored) and is entirely closed off from the outside air (in one embodiment the reservoir is hermetically sealed from the outside although it is not required to be).

A hinge 25 is attaches the flip-top lid 16 to the rest of the removable pill cap case 12. The flip-top lid 16 is shaped to snap onto a top of the removable pill cap case 12 and make a tight friction fit (which would typically not open unless manually opened by the user). The flip-top lid 16 cannot be removed from the removable pill cap case 12.

Figure 3:
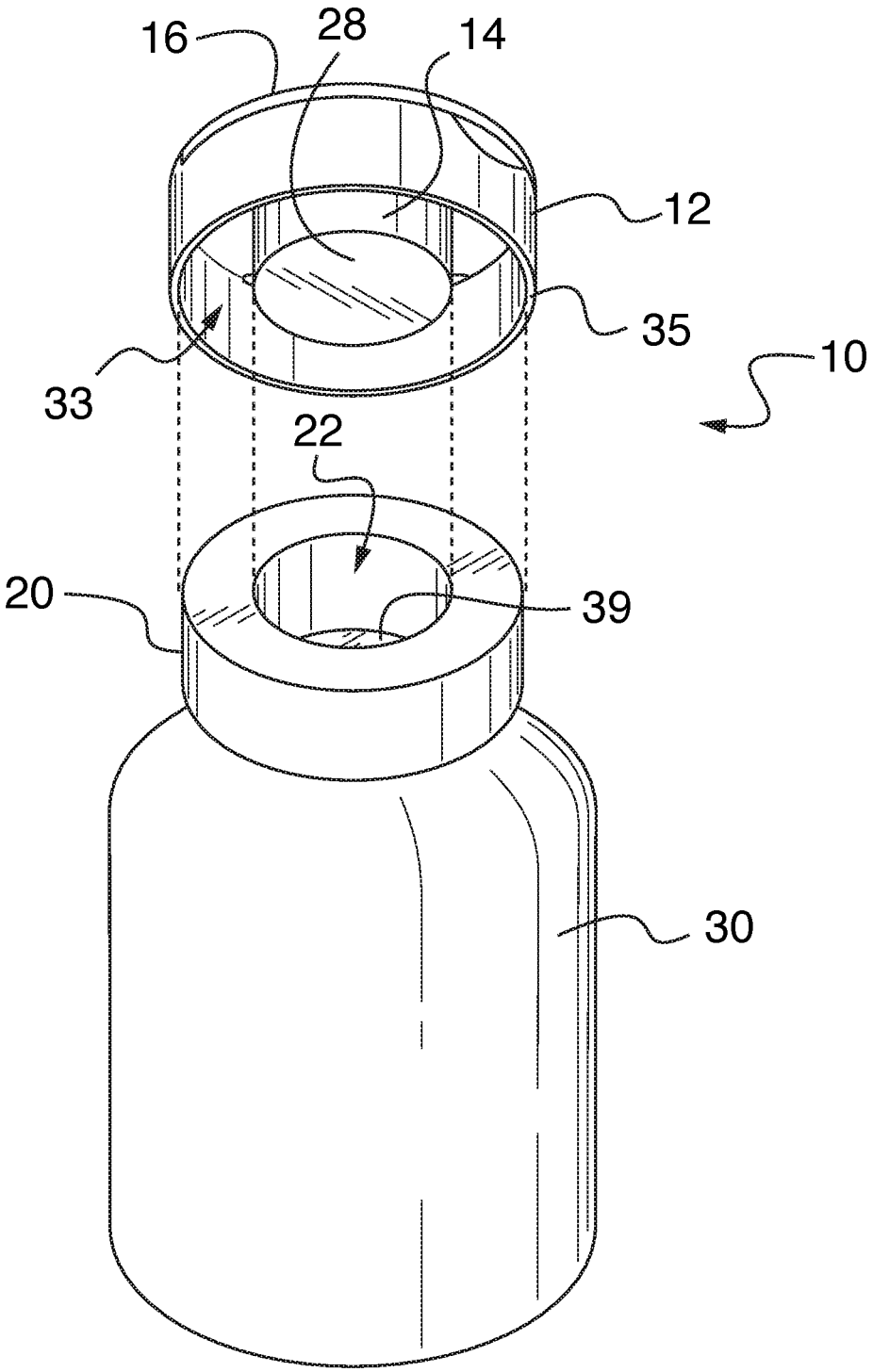
FIG. 3 is a perspective drawing of the pill bottle with the removable pill cap case removed, according to an embodiment.

FIG. 3 is a perspective drawing of the pill bottle with the removable pill cap case removed, according to an embodiment.

The flip-top lid 16 is closed on the removable pill cap case 12. The removable pill cap case 12 is removed from the bottle cap 20. The bottle cap 20 has a bottle cap opening 22 (circular) which is structured to receive the removable pill cap case 12. The removable pill cap case 12 would have a friction fit with the bottle cap opening 22 so that the removable pill cap case 12 (when inserted inside the bottle cap opening 22) would not come out of the bottle cap 20 unless the removable pill cap case 12 was manually pulled out of the bottle cap 20 by the user. The user would manually insert the removable pill cap case 12 inside the bottle cap 20 when he/she wants to mere the removable pill cap case 12 with the bottle cap 20 and would manually remove the removable pill cap case 12 from the bottle cap 20 when he/she wants to separate the removable pill cap case 12.

The removable pill cap case floor 28 is surrounded by the round perimeter 14. An outer circumference 35 of the removable pill cap case 12 is also shown. A hollow area 33 between the outer circumference 35 and the round perimeter 14 friction fits over the bottle cap 20. A bottle cap floor 39 of the bottle cap 20 is where the removable pill cap case floor 28 contacts when the removable pill cap case 12 is fully inserted into the bottle cap 20 (the bottle cap floor 39 and the round perimeter 14 fits inside the bottle cap opening 22).

Note that removable pill cap case 12 can easily be removed (as shown in FIG. 3) from the bottle cap 20 by simple sliding the removable pill cap case 12 out of the bottle cap 20. The removable pill cap case 12 can easily be inserted inside the bottle cap 20 (as in FIG. 1) by pushing the removable pill cap case 12 into the bottle cap 20. The removable pill cap case 12 is considered removably separable from the bottle cap 20 because it can be easily attached to the bottle cap 20 and easily removed from the bottle cap 20, and can be repeatedly inserted into the bottle cap 20 and removed from the bottle cap 20 as many times as needed (no limit).

Figure 4:
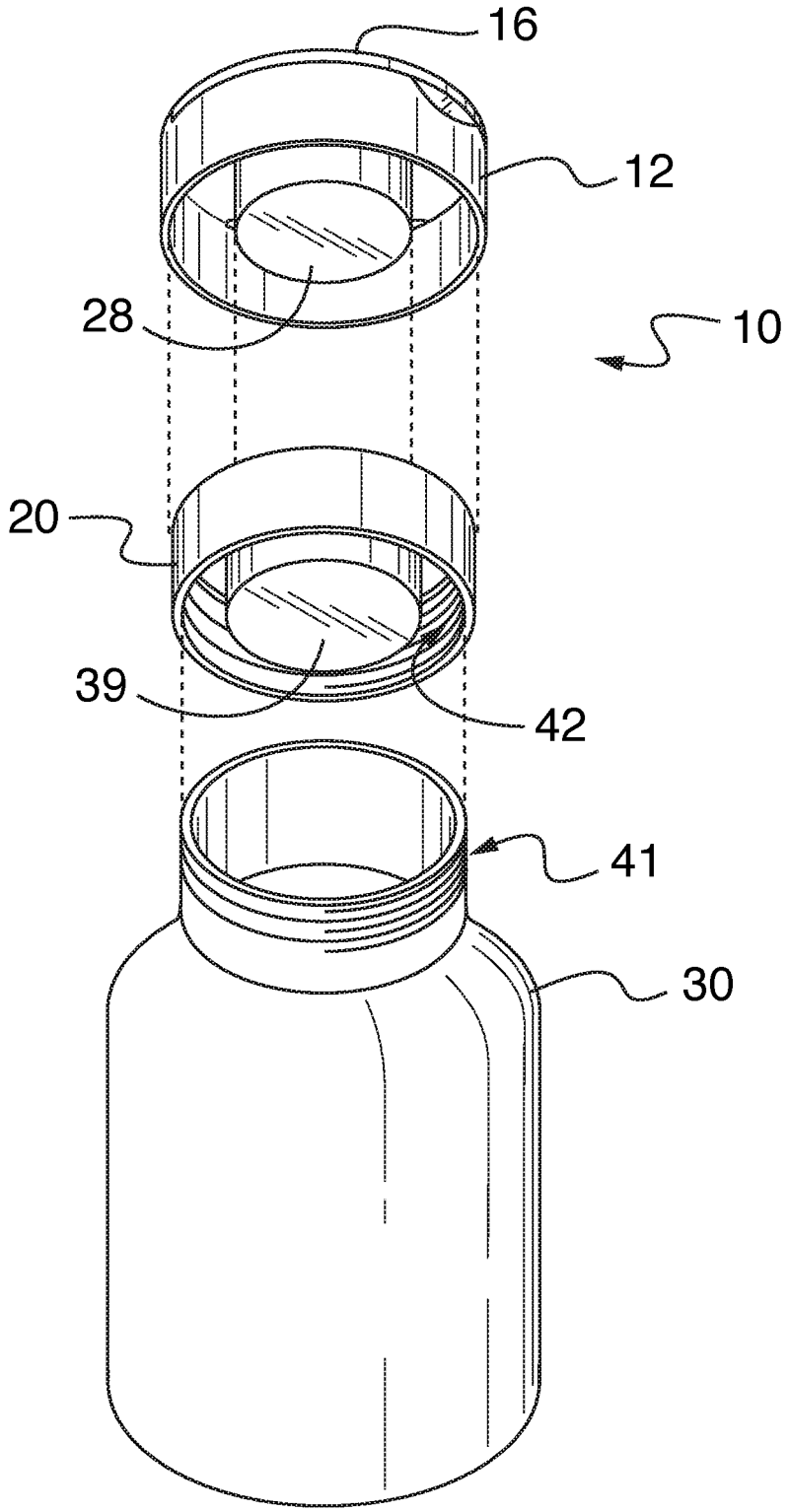
FIG. 4 is a perspective drawing of the pill bottle with the removable pill cap case removed and the bottle cap removed, according to an embodiment.

FIG. 4 is a perspective drawing of the pill bottle with the removable pill cap case removed and the bottle cap removed, according to an embodiment.

The removable pill cap case 12 is removed from the bottle cap 20 which is removed from the pill bottle 30. Note there are threads 41 on a neck of the pill bottle 30 which cooperate with threads 42 on an inside of the bottle cap 20 so that the bottle cap 20 would screw onto the pill bottle 30. Thus, in order to put the bottle cap 20 onto the pill bottle 30 the bottle cap 20 should be screwed onto the pill bottle 30, and to remove the bottle cap 20 from the pill bottle 30 the bottle cap 20 should be unscrewed from the pill bottle 30. Unlike the attachment mechanism between the removable pill cap case 12 and the bottle cap 20 (which does not use threads and can simply slide in and out), the attachment mechanism between the bottle cap 20 and the pill bottle 30 requires screwing (utilizing the cooperating threads). The bottle cap 20 can be considered a standard bottle cap but with a circular hole (bottle cap opening) 22 embedded inside it (but not through the entire bottle cap 20 so that the bottle cap floor 39 remains in a bottom of the bottle cap 20).

Figure 5:
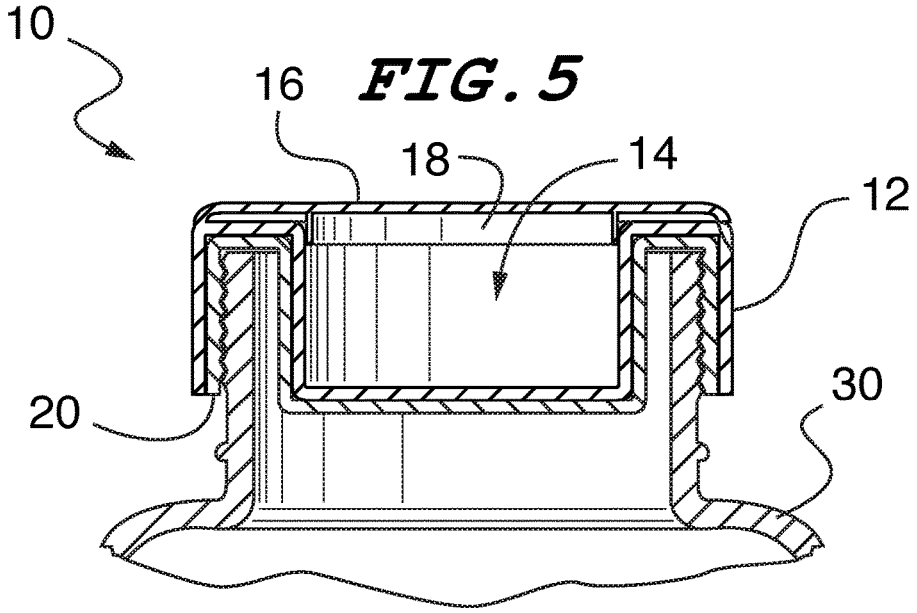
FIG. 5 is a cross section from the view shown in FIG. 1, according to an embodiment.

FIG. 5 is a cross section from the view shown in FIG. 1, according to an embodiment.

The flip-top lid 16 is closed on the removable pill cap case 12 (the flip-top lid 16 could open and close over the removable pill cap case 12 but would not be removable from the removable pill cap case 12 because the flip-top lid 16 is an integral part of the removable pill cap case 12). The round perimeter 14 of the removable pill cap case 12 friction fits into the bottle cap opening 22 thereby causing a snug fit between the removable pill cap case 12 and the bottle cap 20. The ring 18 on the flip-top lid 16 is snugly fit against the round perimeter 14.

Figure 6:
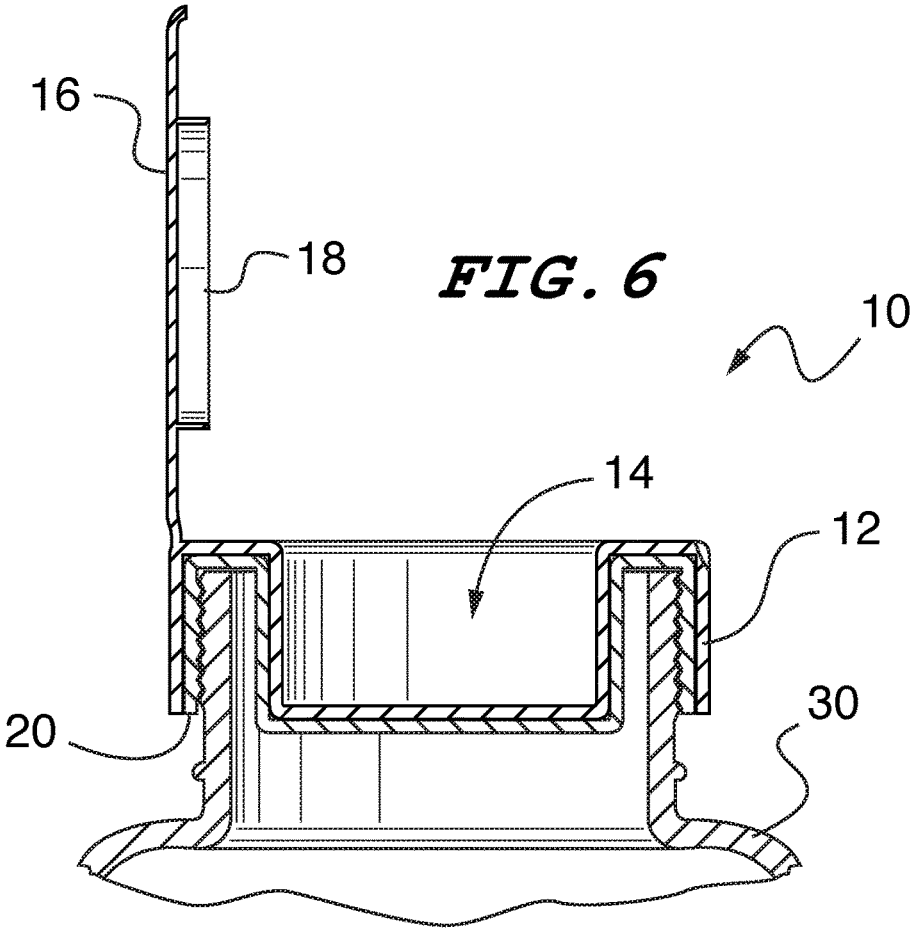
FIG. 6 is a cross section from the view shown in FIG. 2, according to an embodiment.

FIG. 6 is a cross section from the view shown in FIG. 2, according to an embodiment.

FIG. 6 is similar to FIG. 5 but with the flip-top lid 16 open. The flip-top lid 16 easily snaps open and closed. Once closed, the flip-top lid 16 would typically not open until manually opened by a user.

Figure 7:
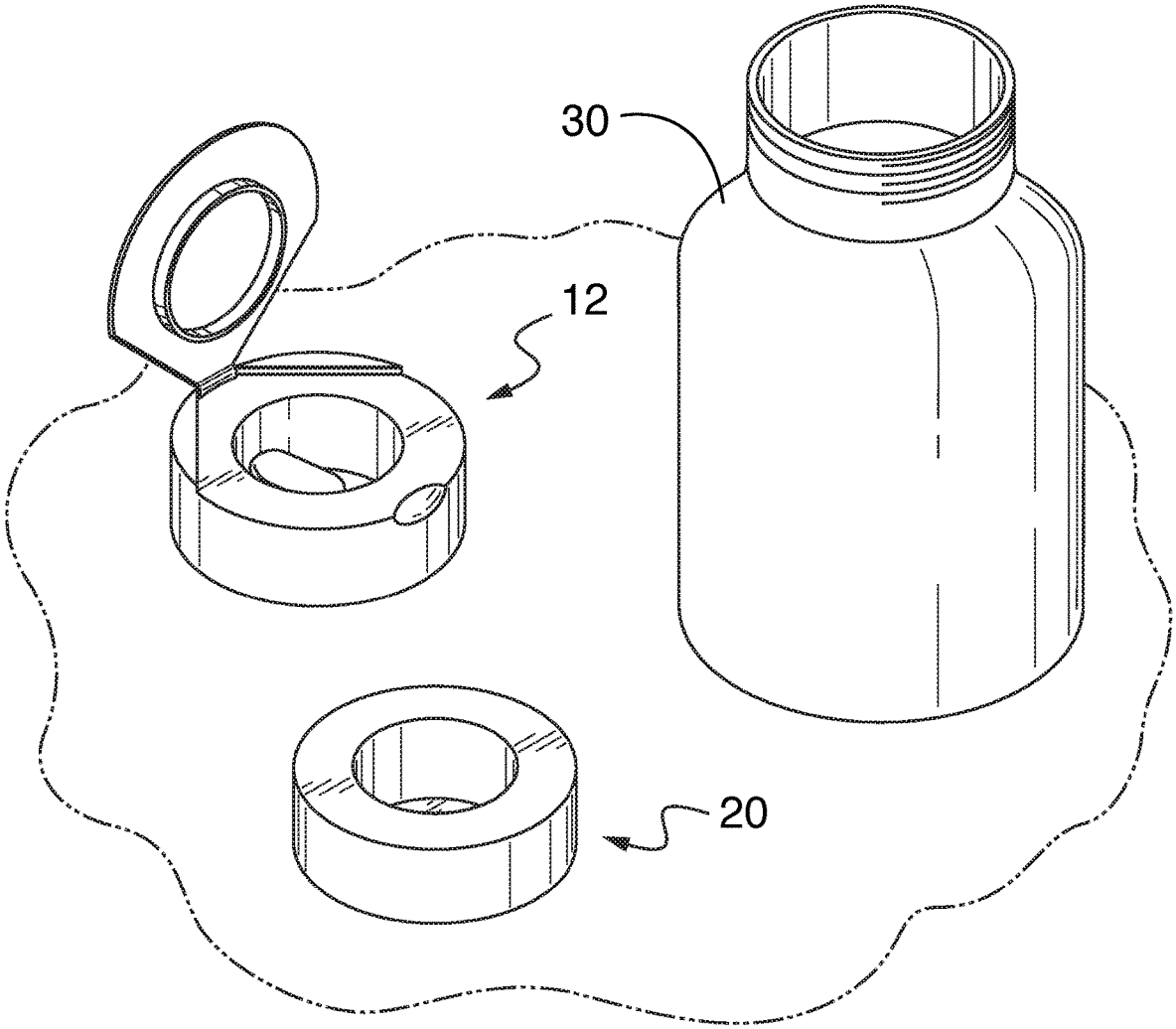
FIG. 7 is a further drawing of the pill bottle with the removable pill cap case and the bottle cap removed, according to an embodiment.

FIG. 7 is a further drawing of the pill bottle with the removable pill cap case and the bottle cap removed, according to an embodiment.

The current system only requires three separable parts, the removable pill cap case 12, the bottle cap 20, and the pill bottle 30. A pill is shown inside the removable pill cap case 12. While only one pill is shown, it can be appreciated that the removable pill cap case 12 can store multiple pills (e.g., 1 to 10 or more).

Figure 8:
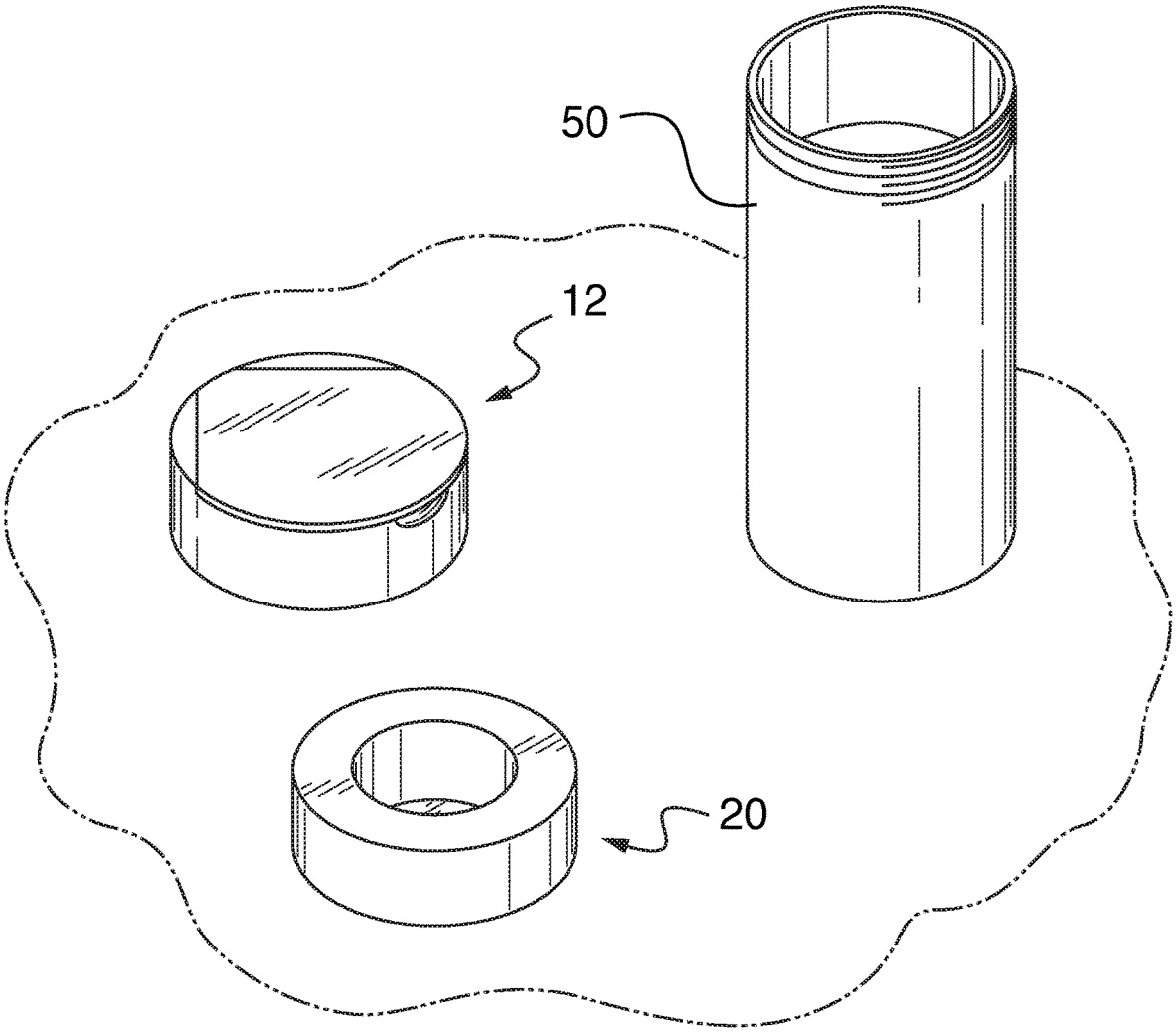
FIG. 8 is a drawing of a pill bottle in a prescription bottle form with a cooperating removable pill cap case and cooperating bottle cap, according to an embodiment.

FIG. 8 is a drawing of a pill bottle in a prescription bottle form with a cooperating removable pill cap case and cooperating bottle cap, according to an embodiment.

The embodiment illustrated in FIG. 8 operates the same as the embodiment shown in FIG. 7 (and as described herein), but the shape of the bottle is different (this is a standard prescription bottle). In an embodiment, a pharmacy can dispense prescription pills inside pill bottle 50 and also include the removable pill cap case 12 and the bottle cap 20 so that the recipient of the prescription can utilize the system described herein. The bottles 50, 30 can be standard bottles (e.g., a standard prescription bottle 50 and a standard vitamin bottle, or any other type of standard bottle), and the system described herein can be utilized with such a standard bottle. For example, the bottle cap 20 can be configured to fit on a standard bottle so that anyone with a standard bottle can utilize the current system (by adding the removable pill cap case 12 and the bottle cap 20). In other words, the bottle cap that comes with a standard bottle can be discarded and replaced with the bottle cap 20 (and the removable pill cap case 12 can be inserted into the bottle cap 20).

Note that the bottle cap 20 as it screws onto the bottle 30, 50 can optionally be a safety bottle cap. A safety bottle cap (as known as a child proof cap or child resistant cap) is a cap which is not easy to open, thereby preventing (or discouraging) children from opening the bottle. The safety bottle cap mechanism can be located on the bottle cap 20 and/or a neck of the bottle 30, 50 (typically the safety bottle cap mechanism is located on both the bottle cap and the neck of the bottle and are configured to cooperate with each other). Some example of safety mechanisms (also referred to as safety bottle cap mechanisms, child proof safety mechanism, safety bottle cap, etc.): in order to remove the cap, the bottle cap has to be pushed downward and then turned; in order to remove the cap, an arrow on the bottle cap has to be aligned with an arrow on the bottle neck; in order to remove the cap, two sides of the bottle cap have to be depressed while the bottle cap is turned. There are a number of other such safety mechanisms, and all of them can be incorporated into the present invention. For example patents on safety bottle cap mechanisms, see U.S. Pat. Nos. 3,679,085 and 6,032,811, which are both incorporated by reference in their entireties. In other words, a safety mechanism is a mechanical mechanism located on the bottle cap and/or the bottle (typically both) which cooperate with each other and make removing the bottle cap from the bottle (after the bottle cap has been screwed/sealed onto the bottle) difficult by requiring strength and/or manual dexterity so that a child would not typically have the ability to remove the bottle cap which is screwed/sealed on the bottle, although an adult typically would be easily able to remove the bottle cap which is screwed/sealed on the bottle because an adult would typically have the strength and/or manual dexterity.

Another advantage of the present inventive concept is that when the pill cap case 12 is removed from the bottle cap 20 on the bottle 30, 50, the bottle cap 20 remains securely on the bottle 30, 50. Thus, the bottle cap 20 does not have to be opened in order to remove the pill cap case 12. If a safety bottle cap is utilized, then the pill cap case 12 can be easily removed without having to open the safety mechanism incorporated into the bottle 30, 50 and/or the bottle cap 20 (while the pill cap case 12 is removed the bottle cap 20 remains on the bottle 30, 50). This can be advantageous since an adult can remove the pill cap case 12 with pill(s) inside from the bottle 30, 50 while leaving the bottle 30, 50 at home and since the bottle and/or bottle cap has a safety mechanism it would be child-proof. Thus, as an example, a parent can place a pill(s) inside the pill cap case and place that over the bottle cap 20 (which is sealed onto the bottle 30, 50 with a safety mechanism). Thus, the child can remove the pill cap case 12 and take the pill(s) inside by himself/herself but would not typically be able to remove the bottle cap 20 from the bottle 30, 50 because the safety mechanism is being utilized. Thus, a parent can leave the bottle 30, 50 with the bottle cap 20 sealed onto it (child-proof safety mechanism) and the pill cap case 12 inserted into the bottle cap 20, which can ensure their child is limited to a single dose (e.g., one pill) of medicine (inside the pill cap case 12) because the child may be able to remove the pill cap case 12 and open the flip-top lid 16 but the child would not be able remove the bottle cap 20 from the bottle 30, 50 because a safety mechanism is used therein.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention. Documents incorporated by reference should not be used to construe ambiguous claim terms in this application.

What is claimed is:

1. An apparatus, comprising:

a bottle cap, the bottle cap comprising a bottle cap opening with a bottle cap floor on a bottom of the bottle cap opening; the bottle cap floor having no holes, and a pill cap case configured to be removably separable from the bottle cap, the pill cap case comprising a reservoir with a pill cap case floor, a lid over the reservoir, and a hollow area between an outer circumference of the pill cap case and a perimeter of the reservoir, wherein the pill cap case and the bottle cap are configured such that the hollow area slides onto the bottle cap.

2. The apparatus as recited in claim 1, wherein the lid is a flip-top lid.

3. The apparatus as recited in claim 1, further comprising at least one pill inside the reservoir.

4. The apparatus as recited in claim 1, wherein the hollow area is toroid shaped.

5. The apparatus as recited in claim 1, wherein the bottle cap is configured to removably attach to a pill bottle.

6. The apparatus as recited in claim 1, further comprising a pill bottle, wherein the bottle cap is configured to removably attach to the pill bottle.

7. The apparatus as recited in claim 6, wherein the bottle cap comprises bottle cap threads and the pill bottle comprises pill bottle threads, the bottle cap threads and the pill bottle threads configured to cooperate to enable the bottle cap to be screwed onto and off of the pill bottle.

8. The apparatus as recited in claim 6, wherein the pill bottle is a prescription pill bottle.

9. The apparatus as recited in claim 1, wherein the pill cap case and the bottle cap are both configured such that when the pill cap case is fully inserted into the bottle cap the pill cap case floor contacts the bottle cap floor.

10. The apparatus as recited in claim 1, wherein the pill cap case and the bottle cap are configured such that the pill cap case is removable by pulling the pill cap case out of the bottle cap.

11. The apparatus as recited in claim 5, wherein the pill cap case and the bottle cap are configured such that the pill cap case is removable by pulling the pill cap case out of the bottle cap.

12. The apparatus as recited in claim 6, wherein the pill cap case and the bottle cap are configured such that the pill cap case is removable by pulling the pill cap case out of the bottle cap.

13. The apparatus as recited in claim 1, wherein the lid is configured to have an open state with the reservoir exposed and a closed state with the reservoir covered.

* * * * *